US010995607B2

(12) United States Patent
Behjat et al.

(10) Patent No.: US 10,995,607 B2
(45) Date of Patent: May 4, 2021

(54) SYSTEM AND METHOD FOR TESTING A BARRIER IN A WELL FROM BELOW

(71) Applicant: Well-Set P&A AS, Stavanger (NO)

(72) Inventors: Nader Behjat, Stavanger (NO); Grant Knight, Stavanger (NO); Craig Usher, Inverclyde (GB)

(73) Assignee: Well-Set P&A AS, Stavanger (NO)

( * ) Notice: Subject to any disclaimer, the term of this patent is extended or adjusted under 35 U.S.C. 154(b) by 124 days.

(21) Appl. No.: 16/467,242

(22) PCT Filed: Dec. 6, 2017

(86) PCT No.: PCT/NO2017/050316
§ 371 (c)(1),
(2) Date: Jun. 6, 2019

(87) PCT Pub. No.: WO2018/106122
PCT Pub. Date: Jun. 14, 2018

(65) Prior Publication Data

US 2020/0080415 A1 Mar. 12, 2020

(30) Foreign Application Priority Data

Dec. 6, 2016 (NO) ..... 20161939

(51) Int. Cl.
*E21B 47/005* (2012.01)
*E21B 33/14* (2006.01)
(Continued)

(52) U.S. Cl.
CPC ..... *E21B 47/005* (2020.05); *E21B 33/14* (2013.01); *E21B 34/06* (2013.01); *E21B 47/06* (2013.01); *E21B 33/134* (2013.01)

(58) Field of Classification Search
CPC ..... E21B 47/005; E21B 33/14; E21B 34/06; E21B 47/06; E21B 33/134; E21B 47/117; G01M 3/28
See application file for complete search history.

(56) References Cited

U.S. PATENT DOCUMENTS 9,759,037 B2 * 9/2017 Shampine ..... E21B 33/134
2005/0028980 A1 * 2/2005 Page ..... E21B 33/1294 166/285

(Continued)

FOREIGN PATENT DOCUMENTS

WO 2001/025594 4/2001
WO 2002/081861 10/2002
WO 2015/169959 11/2015

OTHER PUBLICATIONS

Norwegian Search Report, Norwegian Patent Application No. 20161939, dated Jul. 6, 2017.

(Continued)

*Primary Examiner* — Michael R Wills, III
(74) *Attorney, Agent, or Firm* — Andrus Intellectual Property Law, LLP

(57) ABSTRACT

A system is for pressure testing a barrier in a well from below. The system has a first barrier, a second barrier located below the first barrier in the wellbore, a confined testing space located between said first and second barriers in the well, and a fluid reservoir. The system further has a pressurizing member for pressurizing fluid from said fluid reservoir and for transferring said pressurized fluid into said confined testing space, a pressure sensor for measuring pressure in relation to said confined space; and a pressure data receiver for receiving data from said pressure sensor. There is also described a method for pressure testing a barrier in a well from below.

20 Claims, 3 Drawing Sheets

(51) Int. Cl.

| | |
|---|---|
| ***E21B 34/06*** | (2006.01) |
| ***E21B 47/06*** | (2012.01) |
| *E21B 33/134* | (2006.01) |

(56) References Cited

U.S. PATENT DOCUMENTS

| | | | | |
|---|---|---|---|---|
| 2014/0076563 | A1* | 3/2014 | Lin | C04B 26/04 166/295 |
| 2014/0238694 | A1* | 8/2014 | Fraser | E21B 33/13 166/382 |
| 2015/0159480 | A1 | 6/2015 | Kalyanaraman et al. | |
| 2015/0204155 | A1 | 7/2015 | Patel | |
| 2015/0330214 | A1 | 11/2015 | Duphorne | |
| 2015/0361782 | A1 | 12/2015 | Kjorholt et al. | |
| 2017/0081956 | A1* | 3/2017 | Ganguly | E21B 47/13 |
| 2018/0179886 | A1* | 6/2018 | Espe | E21B 47/002 |

OTHER PUBLICATIONS

International Search Report, PCT/NO2017/050316, dated Apr. 3, 2018.
Written Opinion, PCT/NO2017/050316, dated Apr. 3, 2018.

* cited by examiner

SYSTEM AND METHOD FOR TESTING A BARRIER IN A WELL FROM BELOW

CROSS-REFERENCE TO RELATED APPLICATIONS

This application is the U.S. national stage application of International Application PCT/NO2017/050316, filed Dec. 6, 2017, which international application was published on Jun. 14, 2018, as International Publication WO 2018/106122 in the English language. The International Application claims priority of Norwegian Patent Application No. 20161939, filed Dec. 6, 2016. The international application and Norwegian application are both incorporated herein by reference, in entirety.

FIELD

The present invention relates to a system for testing a barrier in a well from below. More particularly the invention relates to a system comprising a first barrier and a second barrier, the second barrier being located below the first barrier in the well, the system further comprising a confined testing space located between said first and second barriers in the well. The invention also relates to a method for testing a barrier in a well by means of such a system.

BACKGROUND

In the oil and gas industry, safety is always a major concern. Incidents may have severe consequences, such as witnessed in the aftermath of the Deepwater Horizon catastrophe. To prevent such incidents, barriers placed in wells play a leading role. The well barriers are installed mainly to control fluid flow in the well, and ultimately to prevent a blowout, i.e. an uncontrolled release of formation fluids out of the well after the pressure control system, including one or more barriers, has failed.

A barrier set in a well can be said to have two sides: an uphole side and a downhole side. The purpose of the barrier is typically to prevent fluids from moving from the downhole side of the barrier and to the uphole side of the barrier. Thus, the downhole side can be said to be upstream the barrier and the uphole side to be downstream the barrier.

Herein, all references to "above" and "below" a barrier or any other feature in the well, should be construed as closest to surface and closest to the bottom of the well, respectively.

To ensure that a set barrier is able to withstand a given pressure, it is required to pressure test the barrier. Standards, such as NORSOK D-010 relating to well integrity in drilling and well operations, contain detailed requirements for pressure testing of well barriers such as cement-based and mechanical plugs. NORSOK D-010 specifies that barriers should be tested in the direction of potential flow (i.e. an upstream pressure test). However, in the industry cement plugs are typically tested from above (downstream pressure test) as no technique currently exists to effectively test them from below.

Testing of a well barrier from above has certain shortcomings and disadvantages. Firstly, testing a barrier from above implies testing the barrier's ability to withstand overpressure from above the barrier instead of in the normal direction of flow. However, a successful pressure test from above does not necessarily entail that the barrier would be able to withstand the same pressure from the opposite direction, i.e. from the direction where the pressure will normally come from in operation. Secondly, if a barrier is set above a lower barrier which has already been pressure tested, it can be very difficult to accurately pressure test the upper barrier from above, since being able to differentiate between the two pressure tests relies purely on the volume of fluid above each barrier, and this can often be similar if the two barriers are located at similar depths. Thirdly, a successful pressure test of an upper barrier from above will not be able to give any indications of the integrity of one or more lower barriers in the well.

SUMMARY

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates to a system for pressure testing a barrier in a well from below, said system comprising:

- a first barrier;
- a second barrier located below the first barrier in the well;
- a confined testing space located between said first and second barriers in the well; and
- a fluid reservoir, wherein said system further comprises:
- a pressurizing member for pressurizing fluid from said fluid reservoir and for transferring said pressurized fluid into said confined testing space,
- a pressure sensor for measuring pressure in relation to said confined testing space; and
- a pressure data receiver for receiving pressure data from said pressure sensor.

The pressure data receiver may be provided above said first barrier or it may be provided below said first barrier. The pressure data receiver may be adapted to receive pressure data directly from said pressure sensor, or said pressure data receiver may be adapted to receive pressure data from a storage unit adapted to receive and store pressure data from said pressure sensor. The storage unit may also be provided below said first barrier and it may be adapted to communicate wirelessly with said data pressure receiver as will be explained in the following.

The system according to the first aspect of the invention solves at least some of the above-mentioned shortcomings of pressure testing from above by testing the first barrier from below. This is enabled by letting pressurized fluid flow into a confined testing space which is in fluid communication with the lower side of the first plug while at the same time monitoring the pressure in relation to said confined testing space, where a rapid decay in pressure as a function of time may be an indication of the barrier integrity being compromised.

The confined testing space/volume may typically be circumferentially delimitated by a casing or, for an un-cased wellbore, by the formation itself. The upper and lower portions of the confined testing space may be limited by the first and second barriers, potentially via an intermediate membrane as will be explained below, or by the fluid reservoir on one side and one of the barriers on the other side.

The fluid to be pressurized may be a fluid lowered into the well with the aim of releasing it into the confined testing space or it may be a fluid already present in the wellbore. The fluid may be a Newtonian fluid or a non-Newtonian fluid. The fluid to be pressurized may in certain embodiments be water, a water-based drilling fluid, oil-based drilling fluid, cement spacer or base oil. The fluid reservoir may be a naturally occurring reservoir of wellbore already present in the well, or it may be a reservoir lowered into the well with the aim of pressure testing said first barrier from below. In the latter case, the fluid reservoir will have to be conveyed into the well prior to establishing the first barrier, either in the same run into the well or in a subsequent run into the well. The fluid reservoir may be defined by a flexible material or a solid material, wherein said flexible material may or may not maintain its shape as fluid is exerted from the reservoir to be transferred into said confined testing space. The fluid reservoir may be provided with a valve for the ingress of wellbore fluids as the fluid originally contained in the reservoir is transferred into said confined testing volume, which may make it easier to repeat the pressure test. If a naturally occurring wellbore fluid is used to pressurize said confined testing space, the fluid reservoir may be provided with means for separating wellbore fluids from reservoir fluids, which may be beneficial for preventing solids from entering the pumps of the system, which could have a detrimental effect on operation.

In one embodiment said first barrier may be established by means of a fluidized plugging material. Said fluidized plugging material will typically by cement slurry for the formation of a cementplug/barrier. However, fluidized particulate masses are also known for formation of plugs of particulate mass. A somewhat different use of a fluidized particulate mass in a well is described in WO 01/25594 A1 and in WO 02/081861 A1, among other places. When establishing said first barrier in the well, the remaining parts of the system according to the first aspect of the invention may be introduced into the well in the same run as establishing the first barrier, or the first barrier may be established in a subsequent run into the well.

Said system may further comprise a membrane being substantially impermeable to said fluidized plugging material, said membrane defining an upper delimitation of said confined testing space. The membrane may be adapted to confine the fluidized plugging material until it consolidated so that the first barrier is separated from the confined testing space. At the same time, said membrane will be permeable to the high pressures used for the pressure testing from below the plug. At the time of the pressure testing the fluidized plugging material will typically have consolidated into a solid barrier, and the membrane is no longer needed to confine the barrier. The barrier may burst from the applied testing pressure ("burst disc"), or it may contain a one-way relief valve arrangement allowing pressure transfer from below to above the membrane, when a predefined pressure is reached, in the direction towards the lower side of the first barrier. The membrane may be flexible or non-flexible. In certain embodiments, the membrane may have to withstand pressures in the range of 20-80 psi from above in order to hold back the fluidized plugging material. However, during a normal pressure test from below, the membrane may be exposed to pressures in the order of thousands of psi, often from 5000 psi or higher.

In an alternative embodiment, the first barrier may be a mechanical barrier such as one of the following: Bridge plug, storm packer, retrievable packers, flapper valve, fluid loss valve or a surface-controlled subsurface safety valve.

It should be noted that also the second barrier may be a mechanical barrier, such as one of types mentioned above, or a barrier established by means of a fluidized plugging material, as also mentioned above.

In a preferred embodiment said pressure sensor may be located below said first barrier. The pressure sensor may as such be provided in direct fluid communication with said confined testing space, whereby said pressure sensor may be adapted to monitor the pressure in said confined testing space and to transfer pressure data to the storage unit. Preferably the pressure data may be transferred wirelessly across said first barrier, from the pressure sensor and to a receiver above the first barrier, whereby the integrity of the first barrier is not compromised by communication wires extending through the barrier. However, the main technical advantage of the system according to the present invention, as compared to the prior art, is also achieved with wired transfer of pressure data through the first barrier.

In one embodiment the pressurizing member may be a pump. It may be a high-pressure low volume type of pump, such as an intensifier. The pump may pressurize the fluid in the fluid reservoir and transfer it into the confined testing space. Alternatively, the pump may pressurize a wellbore fluid already present in the well, and transfer it to the confined testing space. The pump will typically be controllable by means of a topside and/or downhole control unit. The flow of pressurized fluid from the fluid reservoir and into the confined testing space may be regulated by a control unit and one or more valves, such as one or more check-relief valves allowing flow of pressurized fluid in one direction only, and only after a predetermined pressure has been reached.

In an alternative embodiment, the pressurizing member may be a pressurized fluid container, implying that fluid reservoir and pressurizing member are integrated into one unit. The fluid pressure may thus be pre-set already before the pressurized fluid container is conveyed into the well. The pressurized fluid may be released upon a signal from a control unit, which may be provided topside and/or downhole as mentioned above. The use of a pressurized container has the advantage of avoiding the need for a pump with appurtenant control equipment, which may simplify the system.

In one embodiment said fluid reservoir may include sufficient fluid for pressure testing said barrier two or more times. This may be beneficial if a first or subsequent pressure test was unsuccessful, either because the first barrier itself did not withstand the pressure test or because of equipment failure.

For most practical purposes, the system may comprise a control unit for controlling various equipment of the system. The control unit may be connected to and/or be integrated with a storage unit, and the control unit may be adapted to control the activation and deactivation of the pressurizing member and transfer of pressure data to the storage unit. Further, the control unit may be adapted regulate any valves used in the system. The control unit may be implemented as a microcontroller, a programmable logic control or the like and it may include software and/or one or more pieces of hardware for equipment control. The control unit may be provided below said first barrier, and communicating, preferably wirelessly, with a pressure data receiver through the first barrier, or the control unit may be provided above the first barrier and communication, preferably wirelessly, with various equipment below the first barrier through the first barrier as discussed above.

In a second aspect, the invention relates to a method for pressure testing a barrier in a well by means of a system according to the first aspect of the invention, the method comprising the steps of:

pressurizing fluid from the fluid reservoir and releasing said pressurized fluid into the confined testing space by means of said a pressurizing member;

measuring pressure in relation to said confined space by means of said pressure sensor; and transmitting pressure data from said pressure sensor and to a pressure data receiver above said first barrier.

The pressure data may be continuously transferred from the pressure sensor and to the pressure data receiver during a pressure test, or pressure data may be stored in a storage unit located downhole, and collected subsequently by means of the pressure data receiver.

In one embodiment the step of transferring pressure data may involve transferring the data wirelessly from the pressure sensor below the first barrier and to the pressure data receiver above the first barrier, the advantages of which were discussed above. The pressure data receiver as such may be permanently provided downhole above the first barrier or it may be lowered into the well in order to collected stored pressure data stored locally downhole when needed.

In a preferred embodiment, the method may further include the step of recording pressure as a function of time, and storing multiple pressure/time data pairs in a storage unit. This will make it possible to monitor the pressure changes over time, and also to compare the pressure between different pressure tests.

BRIEF DESCRIPTION OF THE DRAWINGS

In the following are described examples of preferred embodiments illustrated in the accompanying drawings, wherein.

DETAILED DESCRIPTION OF THE DRAWINGS

Figure 1:
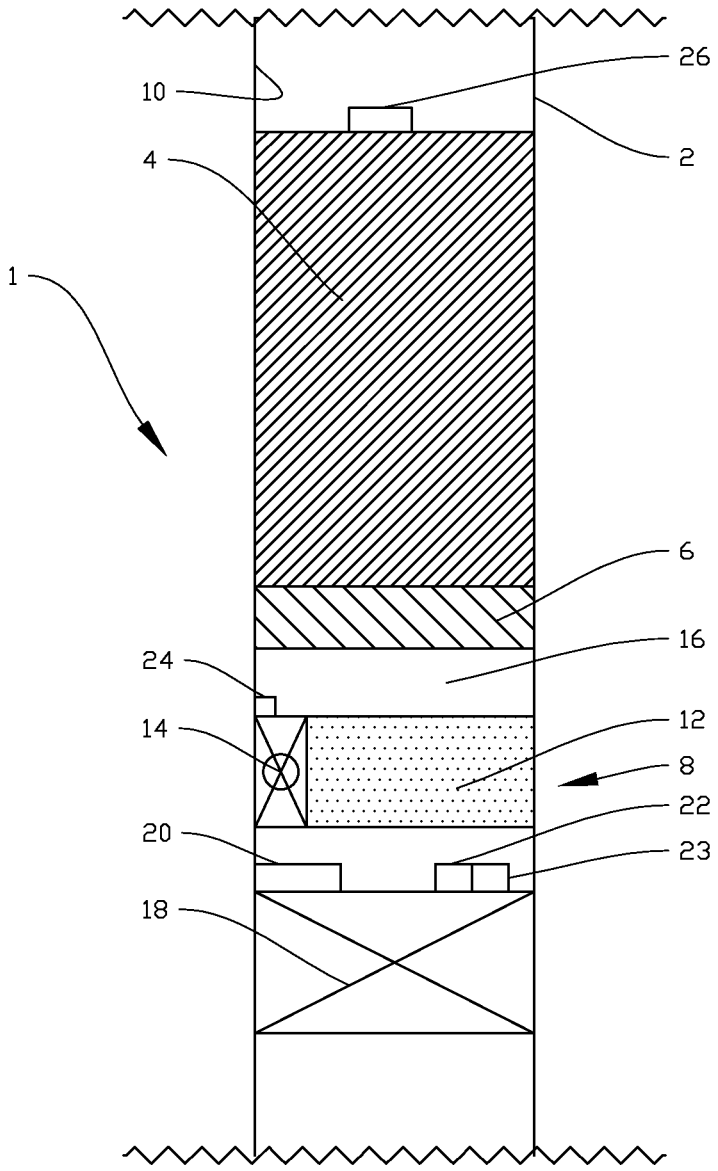
FIG. 1 shows a first embodiment of a system according to the present invention.

In the following the reference numeral 1 will indicate a system according to the first aspect of the invention. Identical reference numerals will indicate identical or similar features in the drawings. The drawings are shown simplified and schematically and the various features therein are not necessarily drawn to scale.

The figures show a portion of a wellbore 10 in which a system according to the present invention is installed. It should also be noted that the wellbore 10 may include a plurality of such systems 1 of equal or different configurations. The wellbore 10 is circumferentially delimitated by a casing 2 in the shown portion.

FIG. 1 shows a first embodiment of a system 1 according to the present invention. A first barrier 4 in the form of a cement plug has been set in the wellbore 10, and the system 1 according to the first aspect of the invention has for its aim to enable testing of the integrity of the first barrier 4 by means of a method according to the second aspect of the invention as will be explained in the following. Below the first barrier 4, is provided a membrane 6. The membrane 6 acts as a fundament for the fluidized cement (not shown) before consolidation of the cement plug 4, and it is substantially impermeable to the fluidized cement slurry. A fluid reservoir 8 contains fluid 12 to be used in the pressure testing of the cement plug 4. By means of a pressurizing member 14, here shown in the form of an high-pressure intensifier, the fluid 12 is pressurized and transferred into a confined testing space/volume 16 between the fluid reservoir 8 and the cement plug 4. Flow of the fluid 12 from the fluid reservoir 8 and into the confined space 16 is enabled by means of a not shown check valve opening at a predetermined pressure, as will be understood by a person skilled in the art. At the bottom of the system 1 is provided a second barrier 18, here in the form of a mechanical plug which may be of one of the types mentioned herein. Between the mechanical plug 18 and the fluid reservoir 8 there is provided a power source 20, here in the form of a battery, and a control unit 22 integrated with a storage unit 23. The battery 20 powers the control unit 22 and the storage unit 23, the intensifier pump 14 and other equipment in need of power supply. The high-pressure pump 14 pressurizes the fluid 8 to a set pressure level, and the pressurized fluid 8 is transferred into the confined space 16. A pressure sensor 24 is placed in the confined space 16 to measure the pressure and transmit pressure data to the storage unit 23. The storage unit 23 is further adapted to transfer pressure data to a pressure data receiver 26 above the first barrier 4 wirelessly. From the pressure data receiver 26, recorded pressure as a function of time may be transferred to topside in real-time, or it may be stored and collected when the pressure data receiver is retrieved from the well. Transfer from the pressure data receiver 26 and to topside may typically be done via a not shown conveying means, such as a wireline, provided with means for wired data and power transfer. The pressure sensor 24 may be powered by its own power source, which may also be a battery, or by the battery 20 powering the other equipment.

Figure 2:
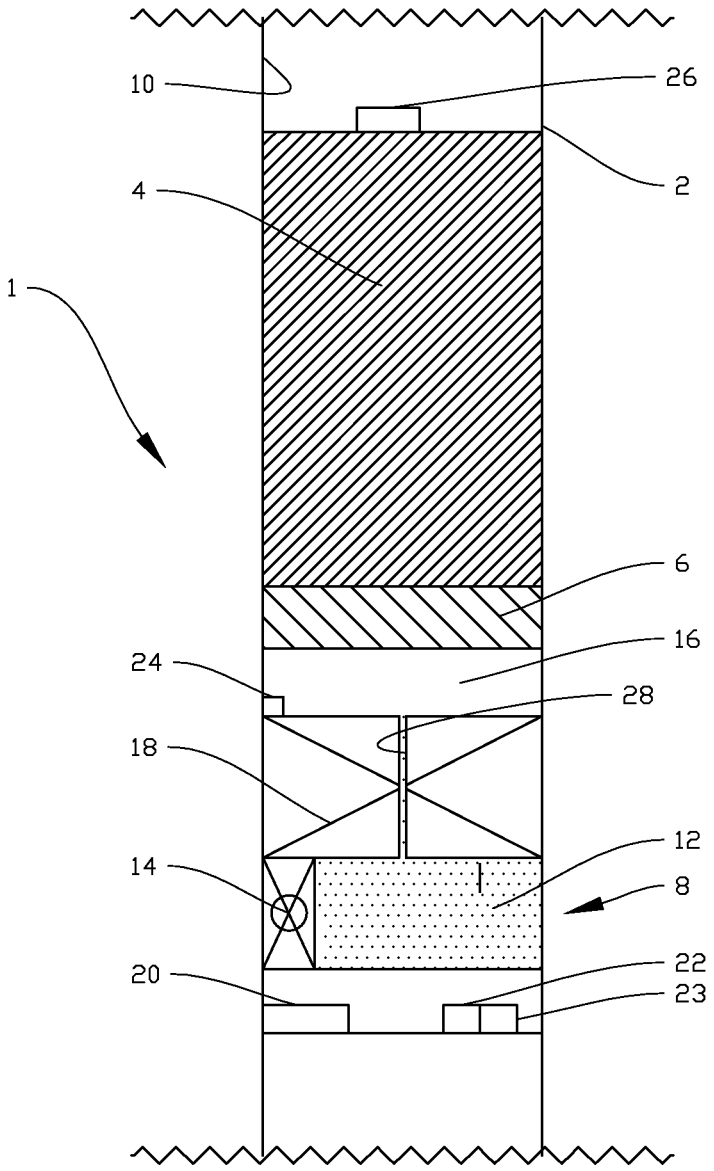
FIG. 2 shows a second embodiment of a system according to the present invention.

FIG. 2 shows a similar embodiment as FIG. 1, with the difference that the fluid reservoir 8 is provided below the second barrier 18, and that a conduit 28 through the second barrier 18 ensures fluid communication between the reservoir 8 and the confined space 16. Valves for control of the fluid flow are not shown, but may be of similar types mentioned above.

Figure 3:
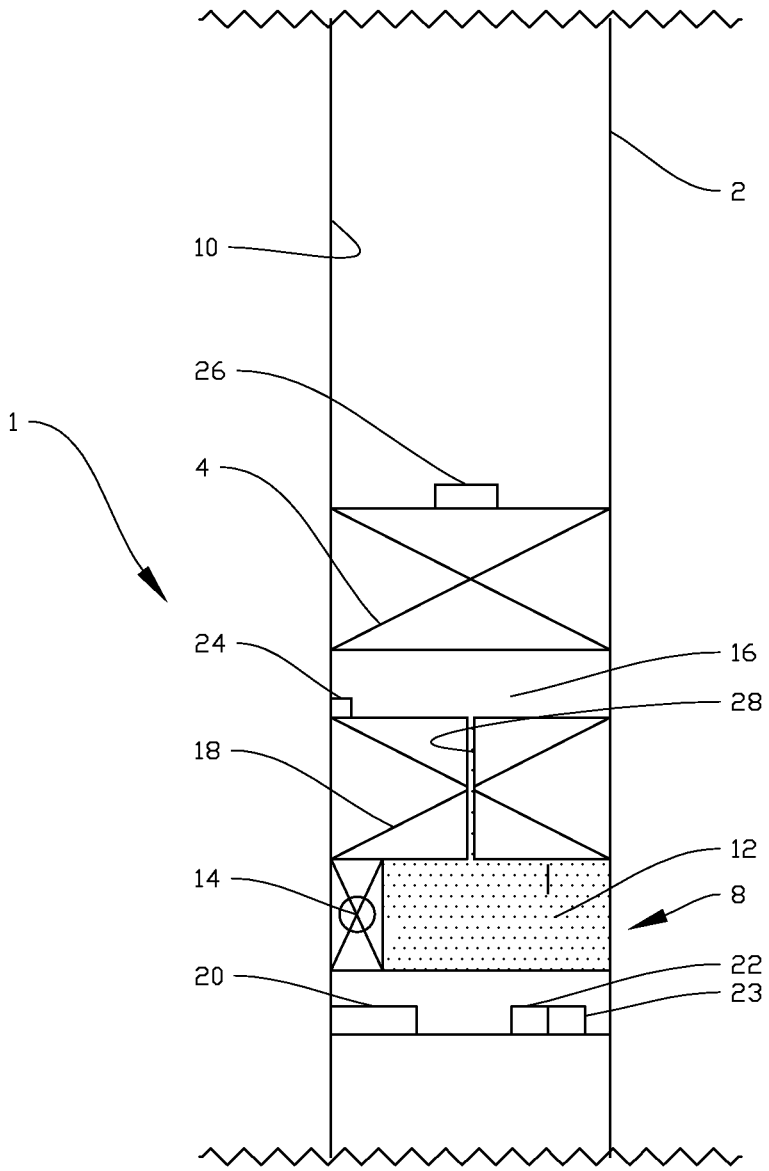
FIG. 3 shows a third embodiment of a system according to the present invention.

FIG. 3 shows an embodiment of a system 1 according to the present invention similar to the embodiment shown in FIG. 2, but where the first barrier 4 is also a mechanical plug. The first mechanical barrier plug 4 may be of a similar or different type as the second mechanical barrier plug 18.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A system for pressure testing a barrier in a wellbore from below said barrier, said system comprising:

a first barrier;

a second barrier located below said first barrier in the wellbore;

a confined testing space located between said first and second barriers;

a fluid reservoir;

a pressurizing member for pressurizing fluid from said fluid reservoir and for transferring said pressurized fluid into said confined testing space;

a pressure sensor for measuring pressure in relation to said confined space; and a pressure data receiver for receiving pressure data from said pressure sensor, wherein said pressurizing member comprises a pressurized container and wherein said fluid reservoir and said pressurizing member are integrated in one unit.

2. The system according to claim 1, wherein said first barrier is established with a fluidized plugging material.

3. The system according to claim 2, further comprising a membrane which is substantially impermeable to said fluidized plugging material, said membrane defining an upper delimitation of said confined testing space.

4. The system according to claim 1, wherein said first barrier is comprises a mechanical barrier.

5. The system according to claim 1, wherein said pressure sensor is below said first barrier.

6. The system according to claim 5, wherein said system comprises a wireless transmission means for wirelessly transferring pressure data from said pressure sensor below said first barrier and to said pressure data receiver.

7. The system according to claim 1, wherein said pressurizing member comprises a pump.

8. The system according to claim 1, wherein said fluid reservoir has a sufficient amount of said fluid for pressure testing said barrier two or more times.

9. The system according to claim 1, wherein said system further comprises a control unit for activating said pressurizing member.

10. The system according to claim 1, wherein said pressurizing member is adapted to pressurize the fluid in said fluid reservoir to a pressure level communicated to said pressurizing member from above said first barrier.

11. A system for pressure testing a barrier in a wellbore from below said barrier, said system comprising:

a first barrier;

a second barrier located below said first barrier in the wellbore;

a confined testing space located between said first and second barriers;

a fluid reservoir;

a pressurizing member for pressurizing fluid from said fluid reservoir and for transferring said pressurized fluid into said confined testing space;

a pressure sensor for measuring pressure in relation to said confined space; and a pressure data receiver for receiving pressure data from said pressure sensor, wherein said pressurizing member is adapted to pressurize the fluid in said fluid reservoir to level pre-set in said fluid reservoir before lowering into the wellbore.

12. The system according to claim 11, wherein said first barrier is established with a fluidized plugging material.

13. The system according to claim 12, further comprising a membrane which is substantially impermeable to said fluidized plugging material, said membrane defining an upper delimitation of said confined testing space.

14. The system according to claim 11, wherein said first barrier comprises a mechanical barrier.

15. The system according to claim 11, wherein said pressure sensor is located below said first barrier.

16. The system according to claim 15, wherein said system comprises a wireless transmission means for wirelessly transferring pressure data from said pressure sensor below said first barrier and to said pressure data receiver.

17. The system according to claim 11, wherein said pressurizing member comprises a pump.

18. The system according to claim 11, wherein said pressurizing member is adapted to pressurize the fluid in said fluid reservoir to a pressure level communicated to said pressurizing member from above said first barrier.

19. A method for pressure testing a barrier in a wellbore from below said barrier, said method comprising:

providing a system comprising a first barrier; a second barrier located below the first barrier; a confined testing space located between said first and second barriers; a fluid reservoir; a pressurizing member for pressurizing fluid from said fluid reservoir and for transferring said pressurized fluid into said confined testing space; a pressure sensor for measuring pressure in relation to said confined space; and a pressure data receiver above said first barrier for receiving pressure data from said pressure sensor;

pressurizing said fluid from the fluid reservoir and releasing said pressurized fluid into the confined testing space via said pressurizing member;

measuring said pressure in relation to said confined space with said pressure sensor;

transmitting pressure data from said pressure sensor and to a-said pressure data receiver; and recording the pressure data as a function of time and storing multiple pressure/time value pairs.

20. The method according to claim 19, wherein the step of transferring pressure data comprises transferring the pressure data wirelessly from the pressure sensor below the first barrier and to the pressure data receiver above the first barrier.

* * * * *